United States Patent [19]

Schmanski et al.

[11] 4,357,001

[45] Nov. 2, 1982

[54] METHOD AND APPARATUS FOR MAKING FENCES

[76] Inventors: Donald W. Schmanski; Thomas J. Rose, both of P.O. Box 1298, Carson City, Nev. 89701

[21] Appl. No.: 669,506

[22] Filed: Mar. 23, 1976

[51] Int. Cl.[3] ..... E04H 17/02; E04H 17/24

[52] U.S. Cl. ..... 256/51; 256/19; 256/50

[58] Field of Search ..... 173/90, 91, 132, 114; 175/20; 61/53.5; 256/48, DIG. 5, 57, 58; 428/373, 378, 388, 920

[56] References Cited

U.S. PATENT DOCUMENTS

| | | | |
|---|---|---|---|
| 51,382 | 12/1865 | Ashdown et al. | 173/132 X |
| 188,916 | 3/1877 | Johnson et al. | 256/57 |
| 295,679 | 3/1884 | Schmitz | 256/57 |
| 299,086 | 5/1884 | Over | 173/90 |
| 620,950 | 3/1899 | Morgan | 256/57 |
| 1,037,345 | 9/1912 | Slaback | 256/58 |
| 1,130,076 | 3/1915 | Eisenmenger | 173/132 |
| 1,452,766 | 4/1923 | Stefan | 256/48 |
| 1,793,106 | 2/1931 | Lindemuth | 256/57 |
| 2,034,709 | 3/1936 | Camp | 256/DIG. 5 |
| 2,525,316 | 10/1950 | Schiff | 173/132 X |
| 2,742,266 | 4/1956 | Voelkerding | 173/91 X |
| 2,861,122 | 11/1958 | Floner | 256/48 X |
| 3,143,817 | 8/1964 | Paulson | 173/90 X |
| 3,310,457 | 3/1967 | Trebilcock | 428/388 X |
| 3,313,356 | 4/1967 | Clevenger | 173/91 |
| 3,464,671 | 2/1969 | Thomas | 256/48 X |
| 3,606,259 | 9/1971 | Farrell | 256/48 |
| 3,669,413 | 6/1972 | Laible | 256/10 |
| 3,696,873 | 10/1972 | Anderson | 173/132 X |
| 3,712,389 | 1/1973 | Smoak | 173/90 X |
| 3,776,522 | 12/1973 | Bartlett | 256/19 |
| 3,814,661 | 6/1974 | Hart | 428/921 X |
| 3,827,997 | 8/1974 | Bergomi | 428/921 X |
| 3,891,189 | 6/1975 | Russo | 256/19 |

FOREIGN PATENT DOCUMENTS

| | | | |
|---|---|---|---|
| 1489766 | 6/1967 | France | 256/57 |

*Primary Examiner*—Dennis L. Taylor

[57] ABSTRACT

A composite fence post is specifically shaped to reduce splitting and shearing and has a driver cap thereon to be driven by an elongate driver tool that encircles the post and that has an interior projection to cooperate with flanges of the post in properly positioning the post as it is driven.

2 Claims, 11 Drawing Figures

METHOD AND APPARATUS FOR MAKING FENCES

BRIEF DESCRIPTION OF THE INVENTION

1. Field of the Invention

This invention relates to fence posts and to method and apparatus for driving fence posts and particularly to composite fence posts and apparatus for positioning them.

2. Prior Art

Fence posts of generally T-shaped configuration have been known and used for many years and it has been known to make such posts out of a variety of materials. Most uncommonly, such posts are made of steel, but more recently such posts have been made of other composite materials, such as fiberglass and resins. The steel posts, while being very strong are subject to the effects of rust and electrolysis and, require the use of insulators if electrified wires are strung across them. In addition, the steel posts are heavy and difficult to handle, and, because they are so rigid an anchor plate must be used to keep them from working loose from the ground in which they are inserted. The anchor plate, near the bottom of the post, is also used to align the post by foot pressure and to gauge the depth of post penetration.

The composite posts have the advantage of being light in weight and therefore are more easily handled. Also, they are not subject to rust or electrolysis and do not require the use of insulators when electrified wires are strung across them. However, the composite posts used in the past are rather flexible and therefore are more difficult to drive into any but soft or loose soils, and particularly to drive in such a way that they remain properly oriented to allow for correct wire stringing therealong. As they are driven, they frequently turn so that the wire hangers of adjacent posts are not properly aligned. Also, it is not unusual, if a relatively short driver is used, for the post to flex and actually be cut by the driver, particularly if the post is being driven into harder ground or if it hits a rock.

In addition, the presently used composite posts frequently split when driven into the ground, especially if the ground is hard, and will readily burn when exposed to a temporary flame because of the organic material used as a binder in the construction of the posts. The torque applied by tautly strung wires and the pressure of spaced barbs will also frequently cause the flanges of such posts to shear.

It has been common, in the past, to drive ends of both the steel and the available composite posts into the ground using a driver tool that telescopes over the upper end of the post and that is dropped to impact on the post and to drive it into the ground. The driver used has been heavy, and, because it must be raised above the post, the driver cannot be made very long or it becomes too cumbersome to handle. For example, if a six foot post is driven with a two and one-half foot long driver, the driver must be raised to a height of eight and one-half feet in the air to place the driver over the end of a post. Many users cannot reach any higher and the driver cannot possibly be made longer for them. If, as is not uncommon, the driver weighs approximately thirty pounds, it can be appreciated that it can be very tiring to have to repeatedly lift the driver to such a great height as it is positioned and used. It is also difficult to hold the post in a vertical position as the driver is raised and dropped.

With the present post and driver apparatus all of these aforementioned difficulties common to previously known composite posts have been overcome.

SUMMARY OF THE INVENTION

Principal objects of the present invention are to provide a method and apparatus for making fences that will allow the use of composite poles and that will allow such poles to be easily positioned and aligned.

Other objects are to provide apparatus, including a non-burnable composite post that is low in cost, that is easily handled and that has a reduced tendency to split and shear, and apparatus for use with the post to simultaneously drive the post and to maintain proper post alignment.

Principal features of the invention include a composite post shaped to reduce the tendency to split and shear and that will not burn when exposed to a temporary flame; a metal cap either permanently or removable placed on the driving end of the post; and a driver that will telescope over the post and that has an interior projection that will cooperate with the post to maintain post and driver alignment. The length of the driver is at least one-half the length of the post being driven and the inside diameter of the driver does not exceed twice the maximum distance of a cross section of the post.

Additional objects and features of the invention will become apparent from the following detailed description, taken together with the accompanying drawings showing preferred forms of the invention.

THE DRAWINGS

In the drawings:

FIG. 1 is a perspective view of a composite, somewhat T-shaped fence post of the invention;

FIG. 2*a* is a perspective view of one embodiment of driver cap-retainer of the invention;

FIG. 2*b*, a similar view of another embodiment of driver cap-retainer;

FIG. 2*c*, a similar view of still another embodiment of the driver cap-retainer;

FIG. 3, a fragmentary view showing a curved flange post with a driver cap thereon and with a spaced, separate retainer;

FIG. 4, a perspective view of the spaced, separate retainer of FIG. 3;

FIG. 5, a perspective view of a driver tool of the invention;

FIG. 6, a side elevation view of the driver tool as used to drive a post;

FIG. 7, a side elevation view of another embodiment of driver tool, having a removable lug pin;

FIG. 8, a fragmentary perspective view of another embodiment of fence post of the invention; and FIG. 9, a similar view of still another embodiment of fence post.

DETAILED DESCRIPTION

Figure 1:
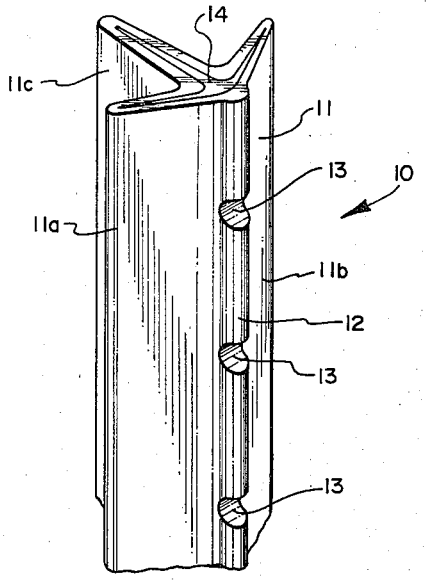

Referring now to the drawings:

In the illustrated preferred embodiment of FIG. 1, the composite fence post of the invention is shown generally at 10. The post includes a body section 11, which preferably is of generally T-shaped configuration, with angled flanges 11*a* and 11*b* and a flange 11*c* that extends from the flanges 11*a* and 11*b* at the junction thereof and within the acute angle formed between flanges 11*a* and 11*b*. A shoulder 12 projects from the junction of the flanges 11*a* and 11*b*, oppositely of the flange 11*c* and spaced apart notches 13 are formed along the length of the shoulder to allow wire to be strung therethrough. Clips, not shown, extend around the body section 11 to hold the wire in the notches.

The body section 11 is formed with a central core 14 of paper or other fibrous material shaped to the general configuration of the desired post and covered with fiberglass and resin to which a snuffing agent, such as aluminum hydrate, has been added, and that is subsequently cured in conventional fashion. The one-piece central core 14 greatly increases the transverse tensile strength of the body section and reduces the tendency of the post to crack or split at the longitudinal axis between flanges. The snuffing agent, of course, keeps the post from burning in the absence of a flame and so that a temporary flame will not necessarily destroy the post.

As previously noted, the body section 11 is of somewhat T-shaped cross section, but with the flanges 11*a* and 11*b* forming an acute angle and sweeping back from shoulder 12. With the swept back flanges a barb on a wire being strung will clear the flanges 11*a* and 11*b* even though the running strand of the wire is held tightly in a notch 13. Also, even if the post is positioned slightly crooked, the running wire will merely pass against one of the flanges 11*a* or 11*b* and will not apply a torque that will tend to shear off the flange. While the somewhat T-shaped configuration of FIG. 1 is presently most preferred, it will be apparent that other configurations can be used, as will be hereinafter described.

Figure 2A:
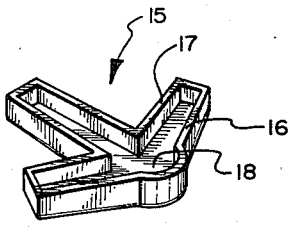

A cap-retainer 15, shown in FIG. 2*a*, has a groove 16 with the same general configuration as the cross section of the body section and large enough to allow the cap-retainer to fit onto one end of the post. Wall 17, surrounding the groove 16 extends from a flat cap portion 18 along the axial length of the post, to completely and closely surround the flanges and to additionally serve as a retainer against splitting as blows are applied to the cap portion and the post is driven into the ground. The wall 17 holds the flanges 11*a*–11*c* together and the cap portion 18 distributes impacts to the three flanges. Both the cap portion and the wall thus serve to prevent or minimize splitting as the post is driven into the ground.

Figure 2B:
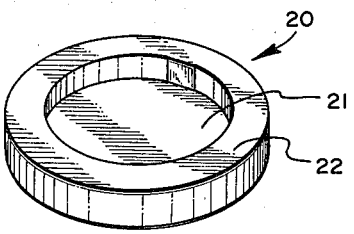

In FIG. 2*b*, another form of cap-retainer is shown at 20. In this embodiment the cap-retainer is of generally circular configuration and the outermost edges of the flanges 11*a*, 11*b* and 11*c* will just fit within cap-retainer 20. As in the previous embodiment when the cap-retainer is placed on the end of a post a cap portion 21 of the cap-retainer will evenly distribute impact force to all of the flanges of the post while the wall 22 of the cap-retainer engages the outermost edges of the flanges of the post to hold them against splitting.

Figure 2C:
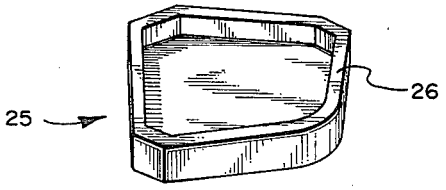

Still another version of cap-retainer is shown in FIG. 2*c* at 25. As shown, the cap-retainer 25 is like the cap-retainer 20, previously described, but instead of being of a generally elliptical configuration it is generally triangular, although one side is curved to allow the wall 26 to clear the shoulder in which the fence wire notches are provided. As with the other embodiments, the cap-retainer 25 is adapted to be positioned on one end of a fence post, such that a cap portion 27 will be flush against the end of the post and the wall 26 will engage the outer edges of the post flanges to keep the flanges from separating when impact forces are applied to the post through the cap portion.

Figure 3:
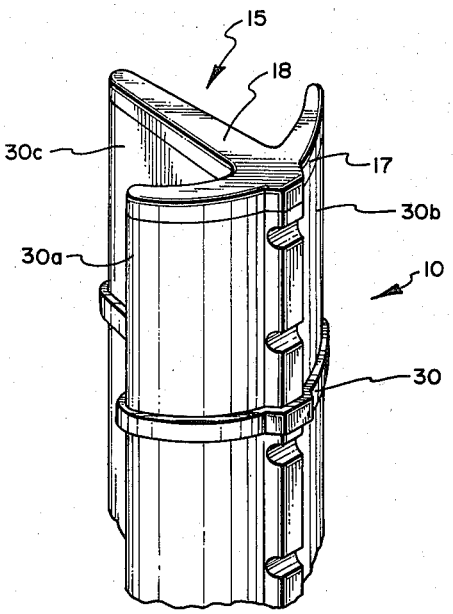
Figure 4:
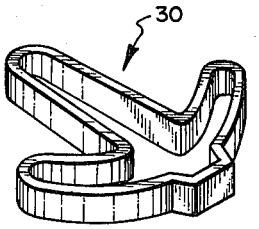
Figure 5:
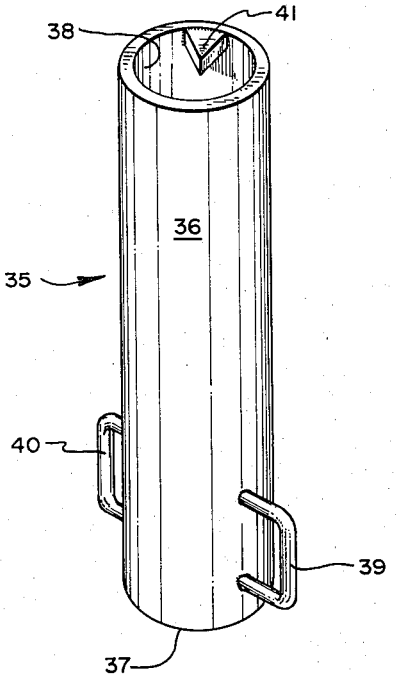

It is also desirable in some cases, such as when extra long poles are being handled, to use a separate retainer member, of the type shown at 30 in FIGS. 3 and 4. Preferably, one or more of the retainer members will fit tightly around the body section 11 of the post at desired intervals. Again, it will be apparent that while in the illustrated embodiment the retainer member 30 engages the walls of the body portion 11, it may be feasible to utilize an encircling member that fits tightly only around the outermost flange edges. Thus, the retainers may be of the same circular or triangular configuration as the walls of the cap-retainers shown in FIGS. 2*b* and 2*c*, or may be of still other configurations that will encircle the post while fitting tightly against the outermost edges of all projecting flanges. In FIG. 3, the flanges 30*a* and 30*b* of the pole 30 are curved rearwardly and swept back from their junction with the rearwardly extending flange 30*c*. The curved configuration of the flanges 30*a* and 30*b*, like the swept back, angled flanges 11*a* and 11*b* shown in FIG. 1, allows strung wire to be somewhat misaligned without applying so much torque to the post that a flange is sheared. Similarly, also, the curved configuration of flanges 30*a* and 30*b* will allow barbs on the post without applying so much pressure to the flanges that they shear.

Figure 6:
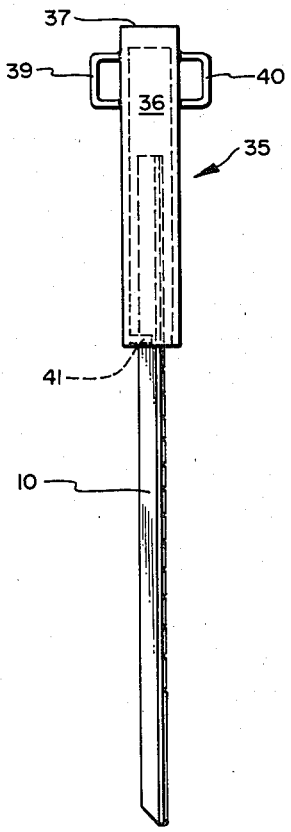

As shown best in FIG. 6, a driver tool for use in driving the post 10 into the ground is shown at 35. The driver tool 35 includes a cylinderical housing 36 having one closed end 37 and an open end 38. A pair of handles 39 and 40 may be positioned at opposite sides of the housing 36, near the closed end 37, although handles are not always needed because of the relative light weight of the driver when compared with drivers previously known, and a lug 41 projects into the housing from the wall thereof at a location near the open end 38.

The driver is made to have an overall length that is at least one-half the total length of the post to be driven and with the interior diameter of the driver not more than twice the maximum cross sectional dimension of the post.

In use, a cap-retainer is tightly fitted on one end of a post and is preferably bonded thereto. The driver is turned to have the open end 38 up, and the end of the post with the cap-retainer thereon is placed in the driver to project upwardly therefrom. When the post is placed in the driver the lug 41 projects between two of the flanges of the post.

Thereafter, the post and driver tool are tipped upside down to place the other end of the post against the ground and the driver in the air above the post, with the closed end of the driver uppermost. A user then grasps the handles 39 and 40 to raise the driver tool above the post and raises the driver tool off the post. He then drops the tool to allow the closed end 37 to impact against the cap-retainer and to drive the post into the ground. With this method, a lightweight composite post weighing approximately 415 gram per lineal meter, i.e. 75.5 grams for a 1.82 meter post is lifted and placed in the driver, and the assembly is then tipped for use. It is not necessary, therefore, to lift a heavy driver full above an upright post to position the driver on the post.

In constructing fences it is generally necessary that the fence retaining notches of the posts be aligned, or at least nearly so, so that wires can be tautly strung thereon. In the past it has been very difficult to maintain alignment of a post without an anchor plate thereon, but with the present invention, the lug 41 prevents turning of the post within the driver and a desired alignment is maintained.

Figure 7:
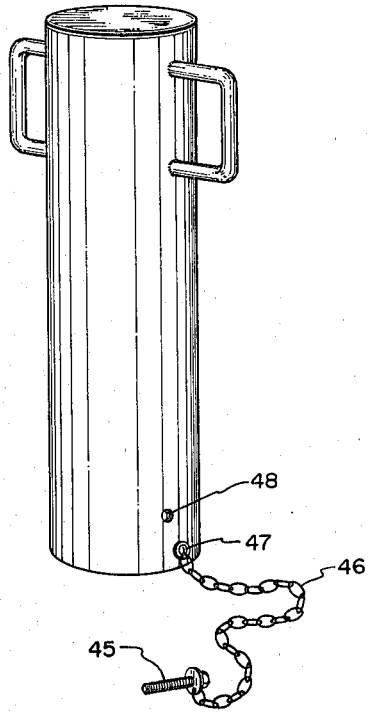

Because it is not always possible to drop a driver tool of the invention over a post, when the post is equipped with a circular or triangular cap-retainer, for example, since the inwardly projecting lug may not clear such cap-retainer, a removable lug can be used, as shown best in FIG. 7. As shown, the lug comprises a pin 45 that is attached to the exterior of the housing 36 by a flexible tether 46. The tether may be attached, for example, to a lug 47 welded to the housing. A hole 48 through the wall of the housing allows the pin to be inserted so that it will serve as an inwardly projecting lug.

The wall of each cap-retainer must extend around the driven end of the post so that chipping and powdering of the top of the post, and cracking or splitting between flanges will be prevented.

The close tolerance between the inner wall of the driver tool and the maximum cross sectional dimension of the post keep the post from bending such that it will break during driving and the separate retainers also prevent such breakage. It has been found, for example, that with a cap-retainer and a separate retainer at the midpoint of the post length, approximately twice the load can be placed on the top of the post before it will fail as will cause failure in a post without such cap-retainer and separate retainer.

Figure 8:
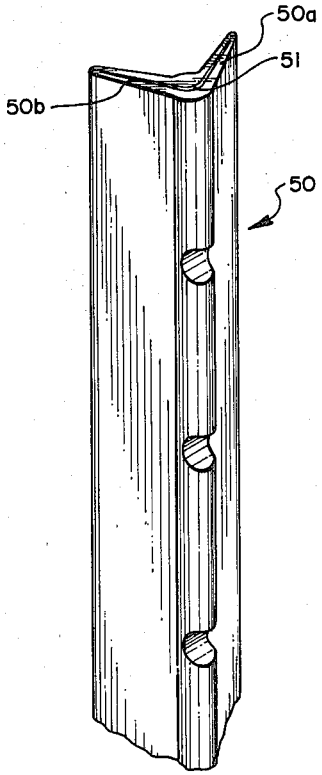
Figure 9:
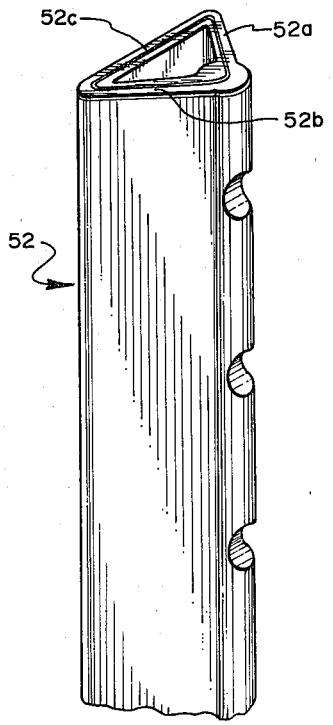

In FIGS. 8 and 9, I have shown other shapes of posts that may be used. In FIG. 8, the post 50 is similar to post 10 of FIG. 1, except that the central flange has not been used and the area 51 at which the angled swept back flanges 50*a* and 50*b* are joined is enlarged to provide additional post strength.

FIG. 9 shows a post 52 like post 50 of FIG. 8, but the edges of the swept back flanges 52*a* and 52*b* are connected by a web 52*c*. This triangular configuration provides even greater resistance to shearing of the flanges 52*a* and 52*b*.

In each of the post configurations disclosed, there may be a central core of the type previously disclosed and the composite materials used include a snuffing agent to reduce the possibility of complete burning of the post. In addition, a pair of swept back flanges extend rearwardly from the elongate junction of the flanges, which junction has wire support means in the form of notches spaced therealong.

Although preferred forms of our invention have been herein disclosed, it is to be understood that the present disclosure is made by way of example and that variations are possible, without departing from the scope of the hereinafter claimed subject matter, which subject matter we regard as our invention.

We claim:

1. A lightweight composite fence post comprising an elongate central wire support means;

an elongate central flange having an edge connected to the central wire support means and projecting therefrom;

a pair of swept back flanges, each having an edge connected to the junction of the elongate central wire support means and the central flange, and an edge spaced from the central flange and each said swept back flange forming an acute angle with the central flange; and a one piece central core of fibrous material in the central and swept back flanges, said flanges being formed of fiberglass and resin covering said central core.

2. A fence post as in claim 1, further including a snuffing agent in the resin.

* * * * *